United States Patent [19]

Wisdom

[11] 4,151,627

[45] May 1, 1979

[54] CLEANING AND COLORING APPARATUS

[75] Inventor: William B. Wisdom, Grand Junction, Colo.

[73] Assignee: Magi Clean, Inc., Grand Junction, Colo.

[21] Appl. No.: 608,487

[22] Filed: Aug. 28, 1975

Related U.S. Application Data

[63] Continuation of Ser. No. 517,691, Oct. 24, 1974, abandoned, which is a continuation of Ser. No. 386,693, Aug. 8, 1973, abandoned, which is a continuation of Ser. No. 191,023, Oct. 20, 1971, abandoned.

[51] Int. Cl.[2] ..... A47L 7/00

[52] U.S. Cl. ..... 15/321; 15/412

[58] Field of Search ..... 15/320, 321, 413, 412

[56] References Cited

U.S. PATENT DOCUMENTS

| | | | |
|---|---|---|---|
| 2,531,370 | 11/1950 | Thompson | 15/321 |
| 3,262,146 | 7/1966 | Hays | 15/321 |
| 3,605,169 | 9/1971 | Howerin et al. | 15/321 |
| 3,614,797 | 10/1971 | Jones | 15/321 X |
| 3,663,984 | 5/1972 | Anthony et al. | 15/321 |

FOREIGN PATENT DOCUMENTS

| | | | |
|---|---|---|---|
| 584806 | 10/1959 | Canada | 15/321 |
| 2047625 | 6/1971 | Fed. Rep. of Germany | 15/321 |
| 408312 | 9/1966 | Switzerland | 15/321 |
| 1203790 | 9/1970 | United Kingdom | 15/321 |
| 1286985 | 8/1972 | United Kingdom | 15/321 |

*Primary Examiner*—Christopher K. Moore
*Attorney, Agent, or Firm*—Arthur A. March

[57] ABSTRACT

A cleaning apparatus providing in one unit, a vacuum cleaner for cleaning wet as well as dry surfaces, and a liquid reservoir with means for converting the liquid into steam. Means are also provided for applying steam to a surface while reclaiming excess deposits of steam into the unit through the vacuum system. The application and reclamation system may also be utilized to dye or tint surfaces.

8 Claims, 5 Drawing Figures

INVENTOR.
WILLIAM B. WISDOM

BY ARTHUR A. MARCH

ATTORMEY

FIG. 3
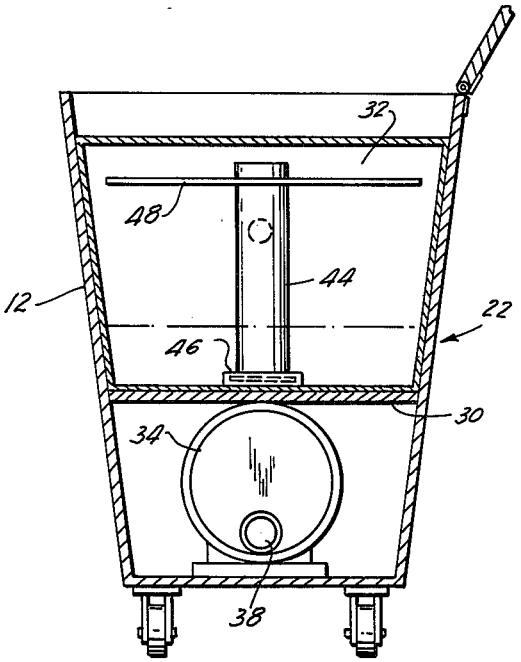
FIG. 4
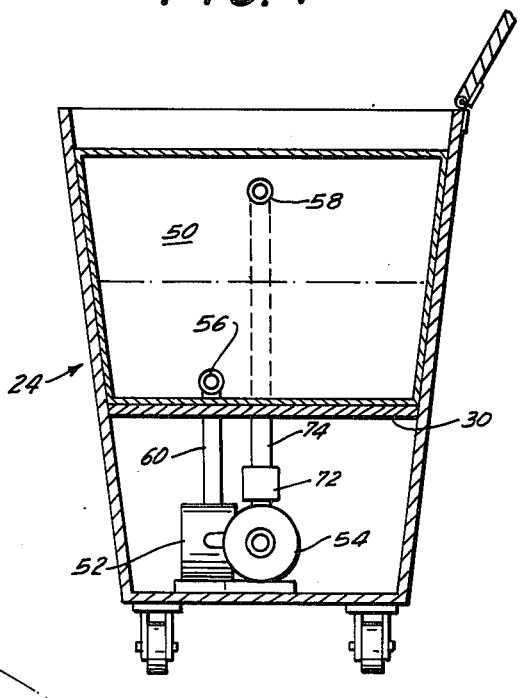
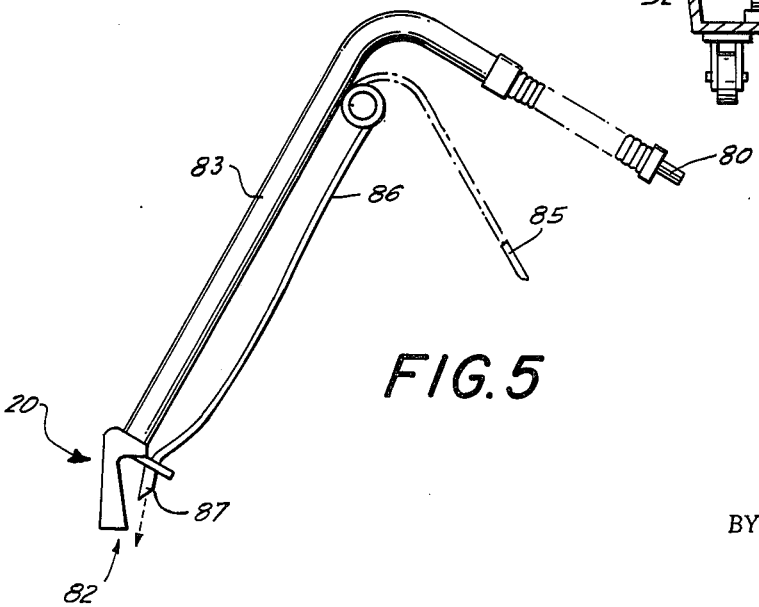
FIG. 5
INVENTOR.
WILLIAM B. WISDOM
BY ARTHUR A. MARCH
ATTORNEY

CLEANING AND COLORING APPARATUS

This is a continuation of co-pending application Ser. No. 517,691, filed Oct. 24, 1974, which is a continuation of co-pending application Ser. No. 386,693, filed Aug. 8, 1973, which is a continuation of co-pending application Ser. No. 191,023, filed Oct. 20, 1971, all of which are, in turn, now abandoned.

BACKGROUND OF THE INVENTION

Heretofore in order to vacuum clean a surface in a dry state, to provide for steam cleaning of surfaces or to dye or tint surfaces, separate machines were utilized with the consequent expense and storage and maintenance problems. Such machines performed only separate tasks and were used individually, separate and apart from each other.

It is an object of the present invention to provide one unit which will vacuum wet as well as dry materials, will provide for steam cleaning and for dyeing or tinting surfaces as, for example, textile or fabric surfaces while at the same time extracting and reclaiming all excess liquid in the form of water or as a dye or tint.

It is a further object of the present invention to provide a cleaning device which will vacuum dry materials such as dirt, ashes, sawdust, as well as wet materials, without any change in the filtering system.

It is still another object of the present invention to provide a cleaning device having an attachment that may be used by hand manipulation for cleaning small or hard to reach areas.

The foregoing objects and others are set forth in the following detailed description of the invention. It is to be understood that this description and the drawings are for exemplary purposes and are not intended to in any way limit the invention as shown by the scope of the appended claims.

DETAILED DESCRIPTION OF THE INVENTION

The apparatus of the invention will be more clearly explained by reference to the attached drawings in which FIG. 1 represents a perspective view of the apparatus taken slightly from the above showing the lid storage of the hand tools;

FIG. 3 is an end cross-section of the machine taken along the line A—A of FIG. 2;

FIG. 4 is an end cross-section taken along the line B-B of FIG. 2; and

FIG. 5 is a view of one embodiment of a wand or hand tool which may be used for the multipurpose operations of the device.

Figure 1:
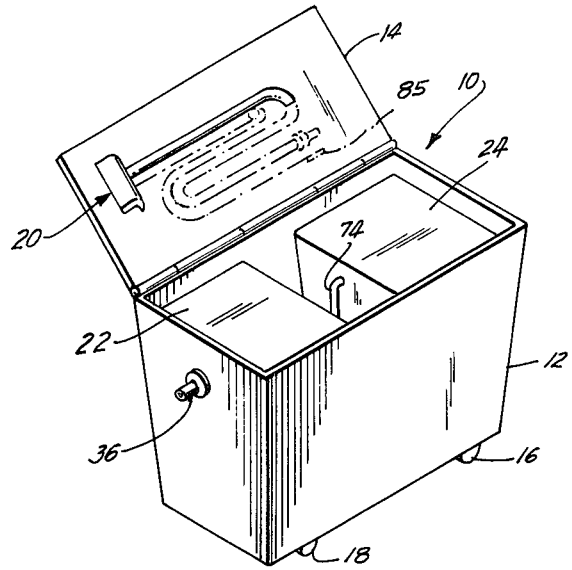

Turning now to the drawings, reference numeral 10 indicates generally the cabinet for the machine which has a cabinet 12 equipped with a hinged lid 14. Four universally swivelled wheels, two of which are shown at 16 and 18, support the cabinet. The lid 14 is adapted for storage of the hand operated attachments, represented by wand 20.

Reference numeral 22 indicates, generally, the vacuum section of the device and 24 the steaming and/or dyeing section.

Cabinet 12 is divided into an upper, or tank section 26 and a lower, or works section 28 by a divider 30, which is fitted into the sides of cabinet 12.

The vacuum section of the machine comprises a vacuum tank 32 and a vacuum pump or motor 34 having an air inlet port 36 and an outlet 38. Inlet 36 extends through the side of cabinet 12 and is equipped at the outer end thereof with a female receptacle which is adapted to receive in air-tight relation a male portion 40 fitted with flexible hose 42. The inner portion of inlet member 36 has a downwardly extending nozzle to deflect incoming air in the direction shown by the arrows.

Vacuum tank 32 is connected to the vacuum motor 34 by means of a standpipe 44 having an opening in the top and bottom thereof. A baffle 48 spaced from the bottom of the tank is situated on the standpipe 44 near to the top of such standpipe and extends across the length and width of the tank and prevents overflow of material or dirt entering the standpipe 44.

As will be more clearly explained as the description proceeds, the vacuum section of the machine is designed for routine cleaning, i.e., simple dust pick-up and the like, and also to pick up moisture from a steaming and/or dyeing operation. Standpipe 44, baffle 48 and filter 46 are designed into the equipment to assure that extraneous matter is prevented from entraining in the air-stream to the vacuum motor.

The steaming and/or dyeing section of the apparatus of the invention comprises generally, a liquid storage vessel or tank 50, a liquid circulating motor pump 52, and a heat exchanger 54. The liquid storage tank 50, which is affixed to and rests upon divider 30, is equipped with a filtered outlet 56 and an inlet 58. Pump 52 when activated by switching means, not shown, circulates liquid from tank 50 through outlet orifice 56, piping 60 and piping 62 to heat exchanger 54. In this electrically powered heat exchanger some of the liquid is converted to steam, when the device is switched to the steaming cycle, and is delivered through pipe 64 and female connector 66.

In order to utilize the machine of this invention when cleaning, steaming, or dyeing corner areas or along borders of an area, a wand or hand-held attachment 20 is provided, as shown in FIG. 5. When not in use the wand is maintained in position under the cover of the machine as shown in FIG. 1. The wand has a nozzle 80 adapted to be inserted into pipe 81 which leads to the vacuum tank 32. When the switch is activated for vacuum cleaning, the cleaning is accomplished through the orifice at 82 and the dirt passes into the vacuum tank through tube 83. When the switch is activated for directing steam or dye to the desired area of a rug, drape, fabric, or the like, the steam or dyeing liquid passes through the flexible tube 68 into the connection 85 and around through pipeline 86 out the orifice 87. As a consequence the hand-held attachment or wand 20 has in one compact unit both the means for accomplishing a vacuum cleaning operation and the steam for a dyeing operation.

In the event that a liquid from tank 50 such as a dye solution, for example, instead of water vapor or steam is required for the operation being carried out, heat exchanger 54 is cut out of the electrical circuit, or reduced to a level which is below the boiling temperature of water and a liquid is delivered by pump 52 through pipe 64, coupling 66 and 70 and flexible hose 68. A valve mechanism, indicated at 72 regulates the amount of liquid delivered to flexible hose 68 for application to the desired area. Excess liquid, and unconverted water during a steaming operation, is recycled by means of pump 52 and line 74 to tank 50.

Figure 2:
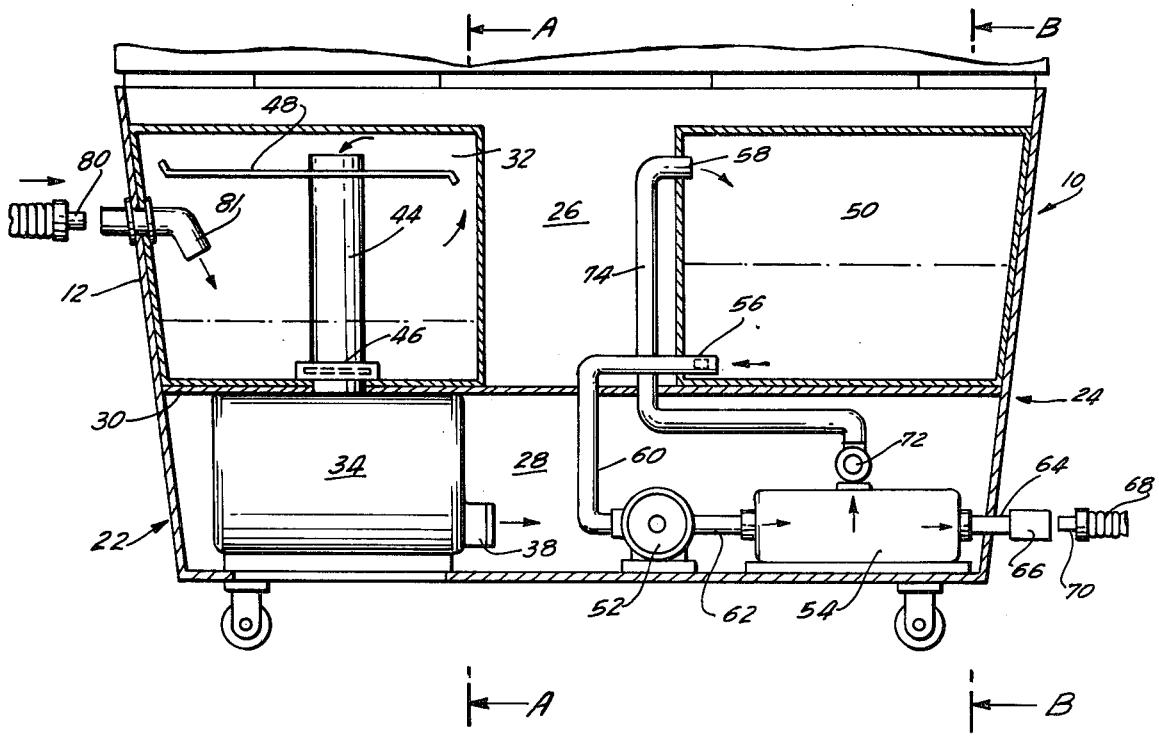
FIG. 2 is a cross-sectional view of the apparatus, showing the relative positioning of the various components.

As another feature of the unique combination of this invention the air outlet 38 from motor or vacuum pump 34 is arranged so that prior to exhaust through the associated cabinet exit 38*a* (FIG. 2) the flow of cooling air is over and around pump 52, an arrangement which is very beneficial as to the longevity of operation of the pump 52.

The device of the invention is electrically operated throughout, that is vacuum motor 34, water pump 52 and heat exchanger 54 are electrically powered. The usual electrical connections and switching combinations are provided such that these elements may be operated singly or in any combination. The electrical circuitry required to accomplish this is well known in the art and forms no part of the invention.

The versatility and flexibility of the apparatus of the invention is thus obvious from the foregoing description. For example, a vacuuming or cleaning operation is accomplished by connecting the flexible hose 42 from the wand to coupler 40, 36 and powering vacuum motor 34. If a steam cleaning operation is desired, either before or after a vacuum cleaning, flexible hose 68 and connector 70 are coupled to connector 66, heat exchanger 54 is energized and circulating pump 52 is again activated and any condensed steam is picked up and deposited in vacuum tank 32 where baffle 48 and standpipe 40 prevents its entrainment with the air stream to vacuum motor 34. When a solution of a detergent or a dye is placed in tank 50, the proper quantity at the desired temperature is delivered to the wand by means of flexible hose 68, coupler 70-66, pipe 64, heat exchanger 54, pipe 62, motor 52, pipe 60 and inlet 56. Again actuation of the vacuum unit permits the operator to pick up the excess suds or dye which is deposited in the liquid section of tank 32, as was explained above.

Thus it will be seen that this invention provides a unique combination of elements which is highly flexible and versatile and which includes a vacuuming operation, a steaming operation and a dyeing operation in one portable compact unit.

What is claimed is:

1. Surface treatment apparatus which comprises in combination:

a portable container;

a vacuum tank disposed within said container and having means for receiving and retaining dry as well as wet material delivered under vacuum to said tank from a surface being treated;

vacuum creating means disposed within said container and operable for creating a material delivery vacuum in said tank;

vacuum applying means operatively connected to said tank and operable for applying said vacuum to such surface to deliver such dry or wet material to said tank;

a liquid reservoir disposed operatively separately from and independently of said vacuum tank and vacuum creating means within said container for supplying liquid for treatment of such surface;

liquid conducting means operatively connected to said reservoir and operable for conducting said liquid to such surface;

liquid heating means disposed within said container and operatively interposed in said liquid conducting means and operable for heating said liquid for treatment of such surface;

liquid flow inducing means disposed within said container and operatively interposed in said liquid conducting means and operable for inducing flow of said liquid from said reservoir; and exhaust means associated with said vacuum creating means and arranged for exhausting vacuum created spent air flow from the vacuum creating means into contact with said liquid flow inducing means within the container at a location operatively remote from said reservoir and operatively adjacent said liquid conducting means;

said liquid conducting means being operatively coextensive with said vacuum applying means external to said container.

2. Apparatus according to claim 1 wherein said liquid conducting means include a liquid flow conduit, in which said liquid heating means and said liquid flow inducing means are operatively interposed, said liquid flow inducing means being operatively interposed in said flow conduit between said reservoir and said liquid heating means, and wherein a recycle conduit is disposed within said container and separately operatively interposed between said liquid heating means and said liquid reservoir and operable for selectively recycling liquid from said liquid heating means back to said reservoir during operation of said liquid flow inducing means.

3. Apparatus accoridng to claim 2 wherein said liquid heating means include liquid converting means operable for converting said liquid into vaporous form for treatment of such surface.

4. Apparatus according to claim 3 wherein said liquid converting means include an electric powered heat exchanger.

5. Apparatus according to claim 1 wherein a portable hand-held device for operative attachment to said portable container is provided and said coextensive liquid conducting means and vacuum applying means external to said container extend substantially in side by side relation along said portable hand-held device.

6. Surface treatment apparatus which comprises in combination:

a self-storing portable container provided with an outwardly confining wall and having compactly disposed therewithin:

a vacuum depository tank for retaining material delivered under vacuum thereto from a surface being treated, a liquid reservoir for supplying liquid self-contained therein for treatment of such surface, and a separate vacuum exhaust and heating chamber containing in confined adjacency therewithin an air suction pump, a liquid pressure pump, a liquid heater and a recycle conduit;

said suction pump being operatively flow connected to said tank and operable for creating a material delivery vacuum in said tank and for discharging the resultant air flow into contact with said pressure pump within said chamber, said pressure pump being operatively flow connected upstream to said reservoir and downstream to said heater and operable for conveying liquid from said reservoir to said heater, said recycling conduit being separately operatively flow connected upstream to said heater and downstream to said reservoir and operable for selectively recycling liquid from said heater back to said reservoir during operation of said pressure pump, and said suction pump, pressure pump, heater and recycle conduit each respectively being selectively independently operable;

vacuum applying means operatively flow connected to said tank and operable for applying said vacuum to such surface to deliver such material to said tank; and liquid conducting means operatively flow connected to said heater and operable for conducting said liquid from said heater to such surface;

said liquid conducting means and vacuum applying means being operatively coextensive external to said container.

7. Apparatus according to claim 6 wherein said coextensive vacuum applying means and liquid conducting means external to said container are removably flow connected to said tank and reservoir through corresponding openings in the wall of said container.

8. Apparatus according to claim 6 wherein said coextensive vacuum applying means and liquid conducting means external to said container are removably flow connected to said tank and reservoir through corresponding attachment openings in the wall of said container and include a common portable hand-held device for corresponding operative attachment to said container at said openings.

* * * * *